US006584816B1

(12) United States Patent
Lee

(10) Patent No.: US 6,584,816 B1
(45) Date of Patent: Jul. 1, 2003

(54) DIRECTION CHANGEABLE HANDLE LOCK STRUCTURE

(75) Inventor: Mei-Kuei Lee, Kaohsiung Hsien (TW)

(73) Assignee: Taiwan Fu Hsing Industrial Co., Ltd. (TW)

( * ) Notice: Subject to any disclaimer, the term of this patent is extended or adjusted under 35 U.S.C. 154(b) by 0 days.

(21) Appl. No.: 10/119,091

(22) Filed: Apr. 10, 2002

(51) Int. Cl.[7] ..... E05B 13/10

(52) U.S. Cl. ..... 70/224; 70/462; 70/DIG. 39; 292/347; 292/244

(58) Field of Search ..... 70/462, 224, DIG. 39; 292/347, 358, 244, 356, 245, 348

(56) References Cited

U.S. PATENT DOCUMENTS 4,471,984 A * 9/1984 Bellantuono ..... 292/350
5,067,758 A * 11/1991 Fann et al. ..... 292/347
5,286,074 A * 2/1994 Lin ..... 292/336.3
5,433,495 A * 7/1995 Uffner ..... 292/169
5,441,318 A * 8/1995 Ghostley ..... 292/336.6
6,141,998 A * 11/2000 Seo ..... 70/224

* cited by examiner

*Primary Examiner*—Anthony Knight
*Assistant Examiner*—John B. Walsh
(74) *Attorney, Agent, or Firm*—Bacon & Thomas, PLLC

(57) ABSTRACT

A direction changeable handle lock structure includes two handles each provided with a first surface and a second surface, and each formed with a combination hole extended through the first surface and the second surface. The handle is formed with a positioning hole communicating with the combination hole. The lock set includes an inner disk unit and an outer disk unit each provided with a shaft tube, for combination with ornamental covers each having a combination portion, so that the combination hole of the handle may be mounted on the combination portion from the first surface or the second surface, and the handle may be fixed by a positioning member.

6 Claims, 8 Drawing Sheets

DIRECTION CHANGEABLE HANDLE LOCK STRUCTURE

BACKGROUND OF THE INVENTION

1. Field of the Invention

The present invention relates to a direction changeable handle lock structure, and more particularly to a direction changeable handle lock structure, wherein the handle of the handle lock may be selectively pressed in the clockwise or counterclockwise direction according to the user's requirements.

2. Description of the Related Art

As shown in FIG. 1, a handle lock 91 used for a door plate 90 is usually mounted on the left side or right side of the door plate 90 according to the user's requirement. The handle lock 91 includes a handle 92 that may be pressed in the clockwise or counterclockwise direction, to drive the lock tongue 94 of the lock latch 93 to retract inward.

As shown in FIG. 2, a conventional handle lock structure is disclosed in U.S. Pat. No. 5,286,074 is shown. In such a conventional handle lock structure, the handles 81 are arranged in a symmetric manner. The normal face or opposite face of the handle 81 may be mounted on the shaft tube 83 by the combination portion 84 of the shaft tube 83 being inserted into the combination hole 82 of the handle 81. The shaft tube 83 is provided with a circular hole 85 of insertion of the cap 86 which has an annular groove 87 aligning with the screw bore 88 of the shaft tube 83, so that the screw 89 may be screwed into the screw bore 88 of the shaft tube 83 and inserted into the annular groove 87 of the cap 86 for fixing the cap 86. However, such a conventional handle lock structure is not provided with a locking function, so that it can only used in a passageway door plate without needing locking, and cannot be available for the site needing locking.

SUMMARY OF THE INVENTION

The primary objective of the present invention is to provide a direction changeable handle lock structure, wherein the handle of the handle lock may be mounted at the left side or right side of the door plate according to the user's requirements, and may be selectively pressed in the clockwise or counterclockwise direction according to the user's requirements.

A secondary objective of the present invention is to provide a direction changeable handle lock structure, wherein the handle of the handle lock may be combined with a lock set needing the locking or unlocking function according to the user's requirements.

In accordance with the present invention, there is provided a direction changeable handle lock structure including two handles each provided with a first surface and a second surface, and each formed with a combination hole extended through the first surface and the second surface. The handle is formed with a positioning hole communicating with the combination hole. The lock set includes an inner disk unit and an outer disk unit each provided with a shaft tube, for combination with ornamental covers each having a combination portion, so that the combination hole of the handle may be mounted on the combination portion from the first surface or the second surface, and the handle may be fixed by a positioning member.

Further benefits and advantages of the present invention will become apparent after a careful reading of the detailed description with appropriate reference to the accompanying drawings.

DETAILED DESCRIPTION OF THE PRESENT EMBODIMENTS

Figure 1:
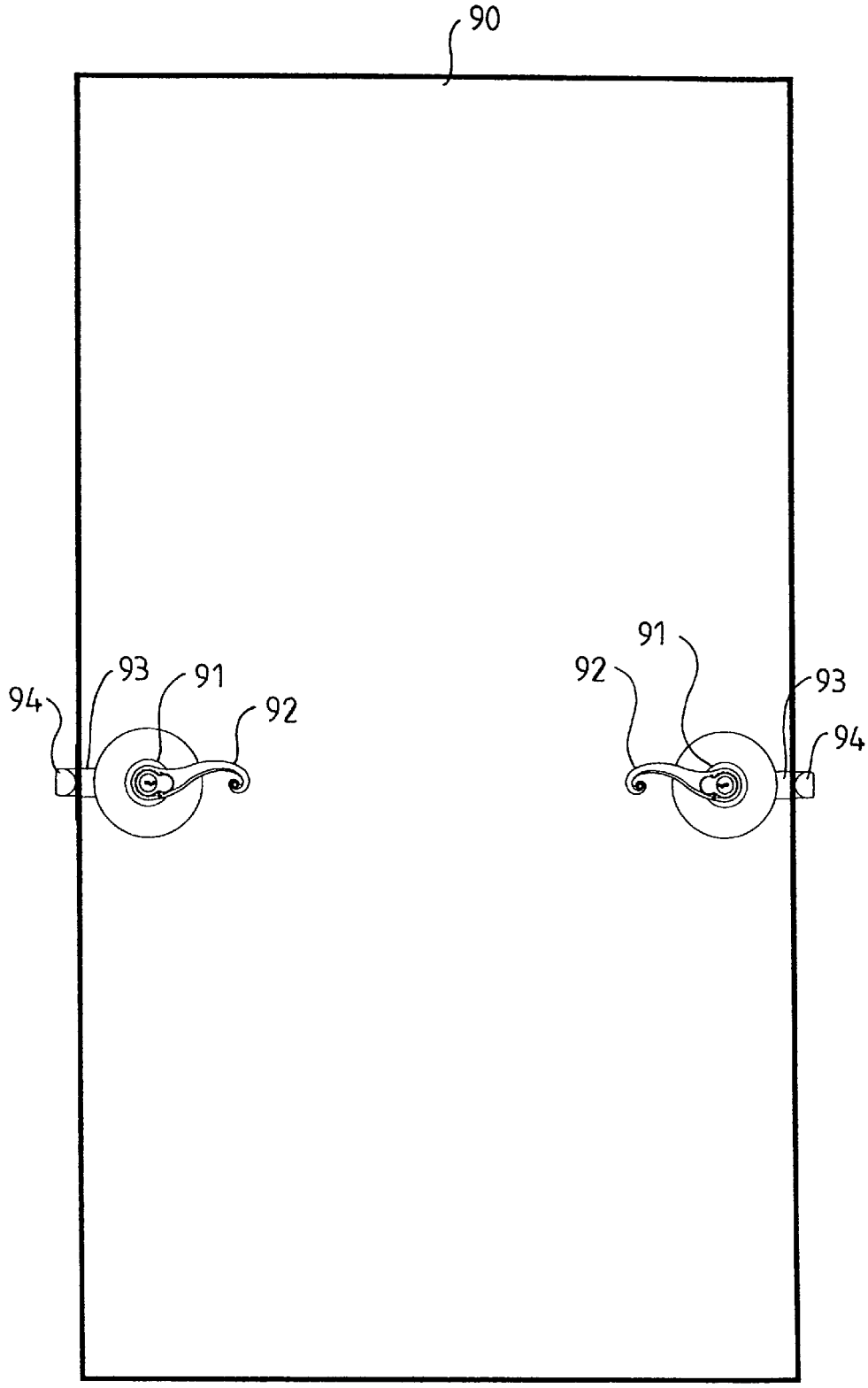
FIG.1 PRIOR ART
FIG. 1 is a plan view of a first conventional handle lock structure in accordance with the prior art.
Figure 2:
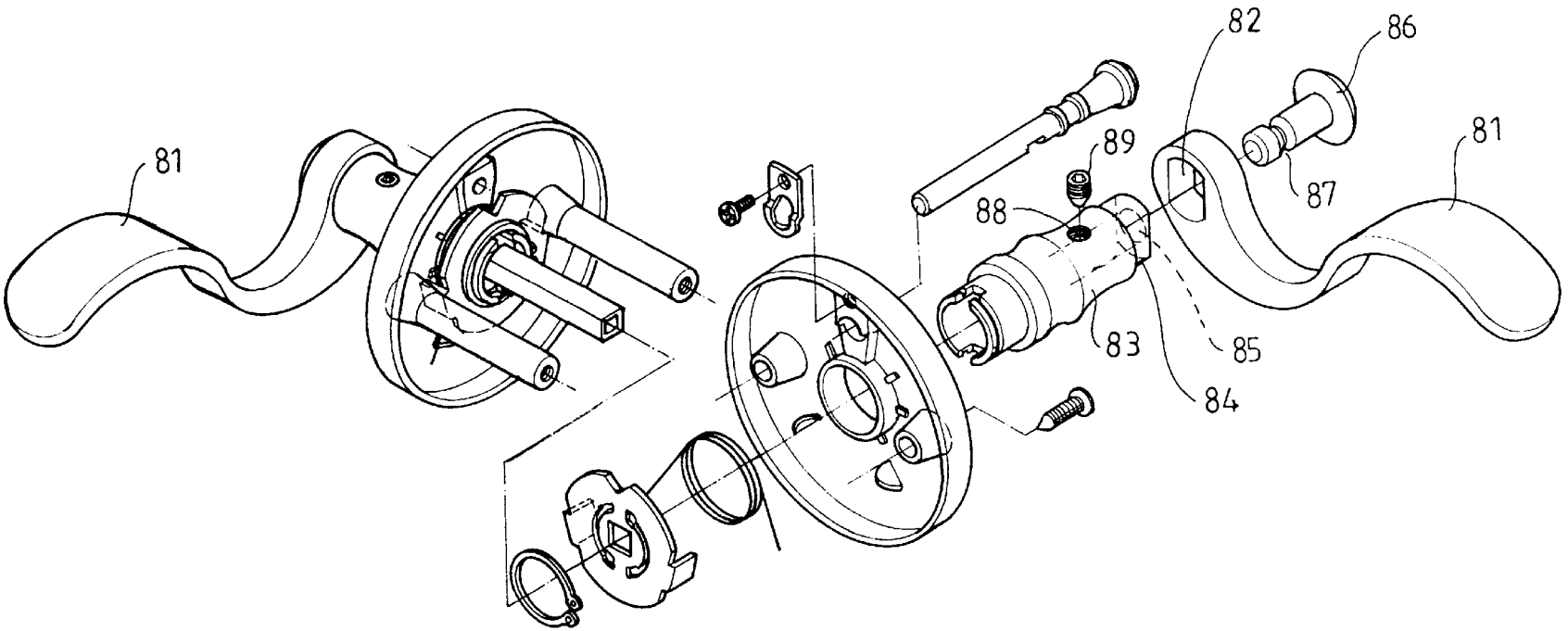
FIG. 2 PRIOR ART
FIG. 2 is an exploded perspective view of a second conventional handle lock structure in accordance with the prior art.
Figure 3:
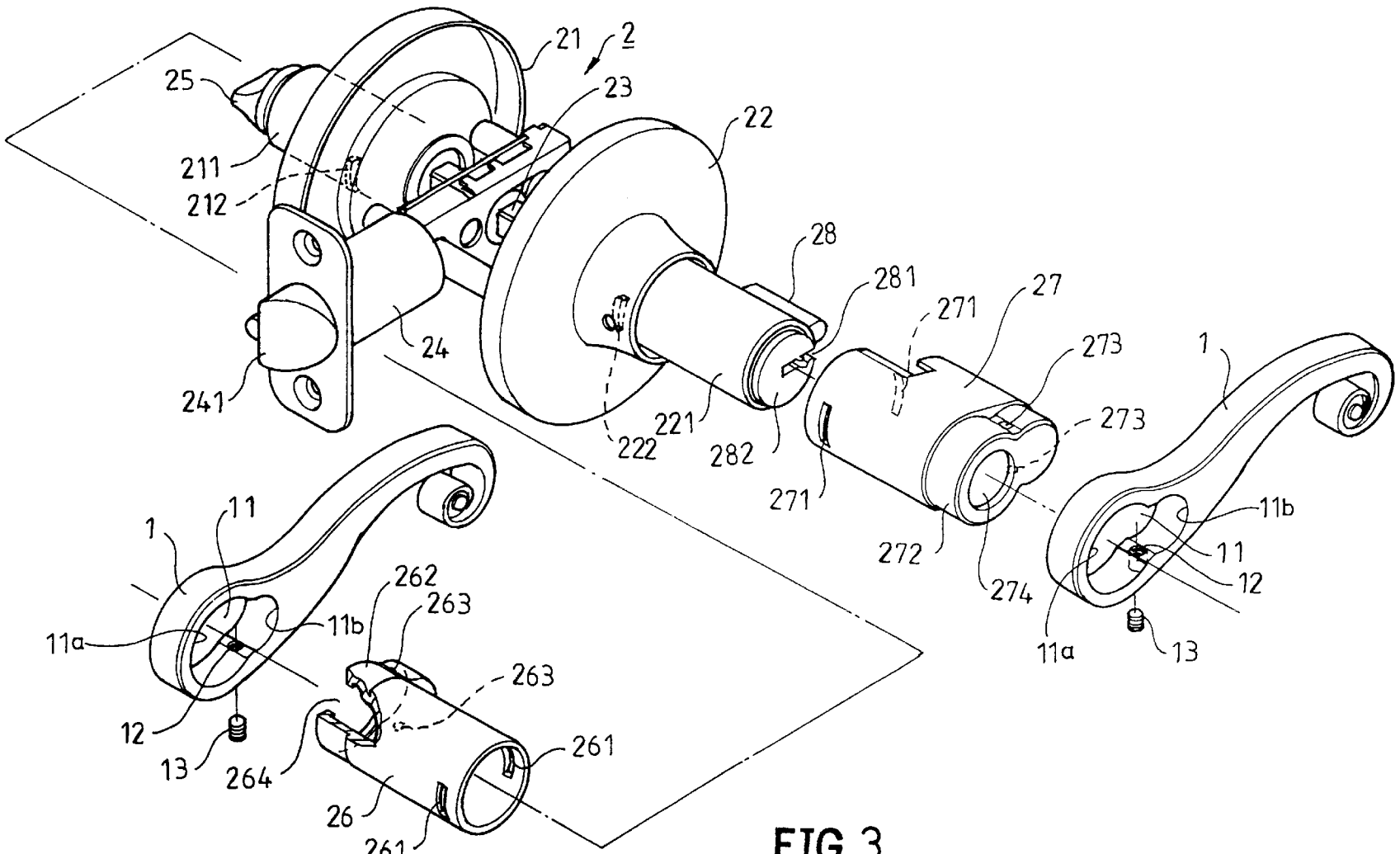
FIG. 3 is an exploded perspective view of a direction changeable handle lock structure in accordance with a first embodiment of the present invention.

Referring to the drawings and initially to FIG. 3, a direction changeable handle lock structure in accordance with a first embodiment of the present invention is available for a door plate for separating the indoor and the outdoor, and may be controlled to have locking and unlocking functions. The knob 25 may be used to control the locking and unlocking actions of the inner side of the door plate, and the correct key may be used to control the locking and unlocking actions of the outer side of the door plate. The direction changeable handle lock structure in accordance with the first embodiment of the present invention comprises handles 1 and a lock set 2.

The handle 1 has a first surface 1*a* and a second surface 1*b*, and is formed with a combination hole 11 extended through the first surface 1*a* and the second surface 1*b*, so that the handle 1 may be mounted on the inner ornamental cover 26 and the outer ornamental cover 27 of the inner disk unit 21 and the outer disk unit 22 of the lock set 2 by the combination hole 11. The handle 1 is formed with a positioning hole 12 communicating with the combination hole 11. In the present embodiment of the present invention, the positioning hole 12 is located at the bottom of the handle 1, so that the handle 1 may have a better outer appearance. A positioning member 13 may be extended through the positioning hole 12, so that the handle 1 may be combined on the inner ornamental cover 26 and the outer ornamental cover 27 of the inner disk unit 21 and the outer disk unit 22 of the lock set 2. In the present embodiment of the present invention, the positioning member 13 may be a screw, and the positioning hole 12 may be a screw bore. Thus, the assembly direction of the handle 1 may be changed easily and conveniently.

The combination hole 11 comprises a central hole 11*a* and an eccentric hole 11*b* in communication therewith, as shown in FIG. 3, and each of the inner ornamental cover 26 and the outer ornamental cover 27 are provided with a radially protruded combination portion 262, 272, so that the eccentric hole 11*b* of the handle 1 may be mounted on the combination portion 262, 272 from the first surface 1*a* or the second surface 1*b*.

The lock set 2 includes an inner disk unit 21, an outer disk unit 22, and a drive shaft 23 extended through the inner disk unit 21 and the outer disk unit 22. The drive shaft 23 is also extended through the drive wheel of the lock latch 24, to draw the lock tongue 241 of the lock latch 24 to operate. The inner disk unit 21 has an inner shaft tube 211, and the outer disk unit 22 has an outer shaft tube 221. In the present embodiment of the present invention, the inner shaft tube 211 is provided with a knob 25 that may drive the drive wheel 23 to rotate, and the outer shaft tube 221 is provided with a lock core unit 28 which is provided with a key slot 281 for insertion of a correct key to drive the lock core 282 to rotate and drive the drive wheel 23 to rotate. The inner ornamental cover 26 is provided with locking slots 261 for locking the locking blocks 212 of the inner shaft tube 211, for positioning the inner ornamental cover 26. The inner ornamental cover 26 is provided with a combination portion 262 that may be mounted in the combination hole 11 of the handle 1. The combination portion 262 is provided with two opposite positioning cavities 263, and one end of the positioning member 13 may be rested in one of the two opposite positioning cavities 263. The inner ornamental cover 26 has an end face formed with a hole 264 from which the knob 25 protrudes. The outer ornamental cover 27 is provided with locking slots 271 for locking the locking blocks 222 of the outer shaft tube 221, for positioning the outer ornamental cover 27. The outer ornamental cover 27 is provided with a combination portion 272 that may be mounted in the combination hole 11 of the handle 1. The combination portion 272 is provided with two opposite positioning cavities 273, and one end of the positioning member 13 may be rested in one of the two opposite positioning cavities 273. The outer ornamental cover 27 has an end face formed with a hole 274 for exposing the key hole 281 of the lock unit 28, so that the correct key may be inserted into the key hole 281 of the lock unit 28.

Figure 4:
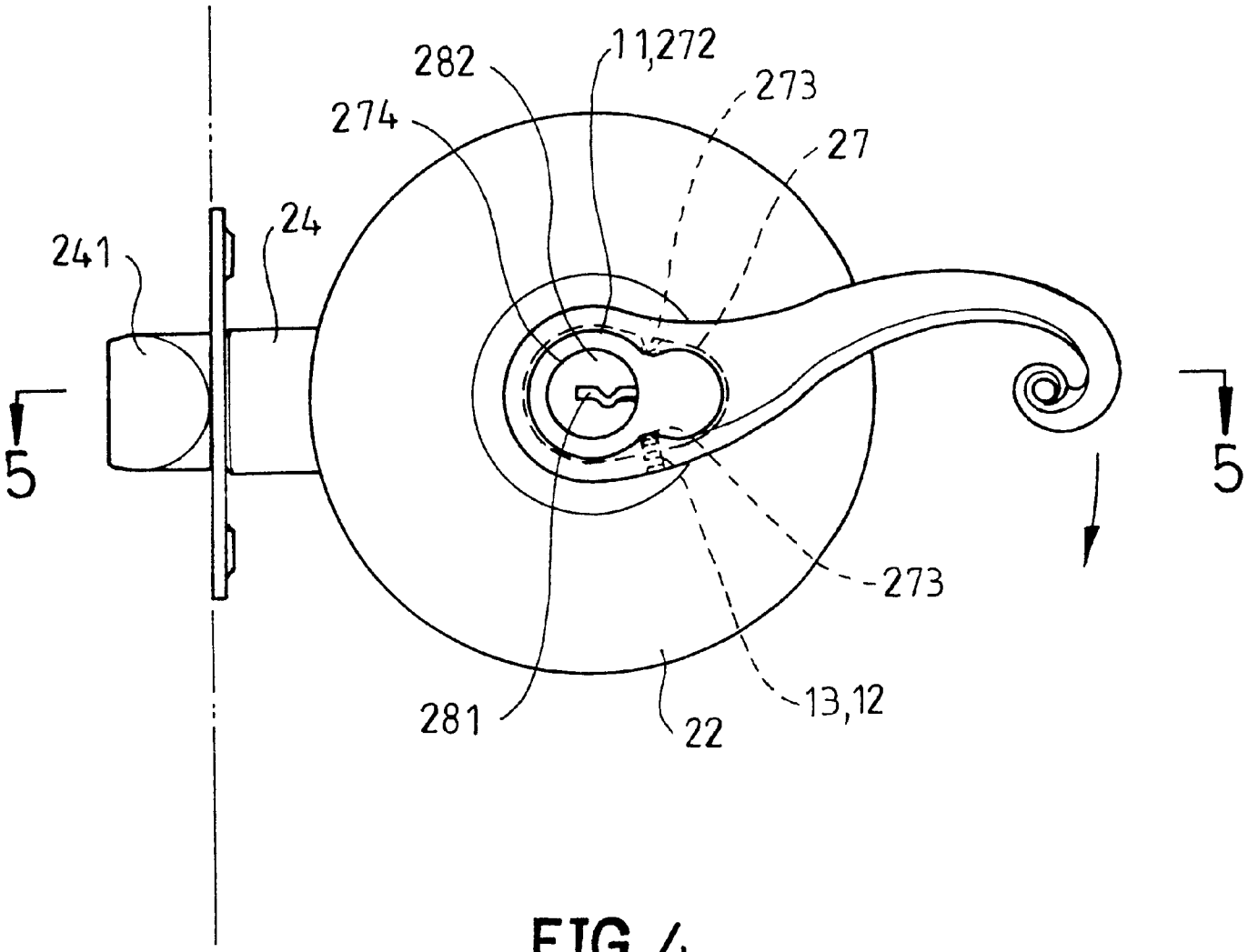
FIG. 4 is a plan assembly view of the direction changeable handle lock structure as shown in FIG. 3, wherein the handle lock is mounted on the left side of the door plate.
Figure 5:
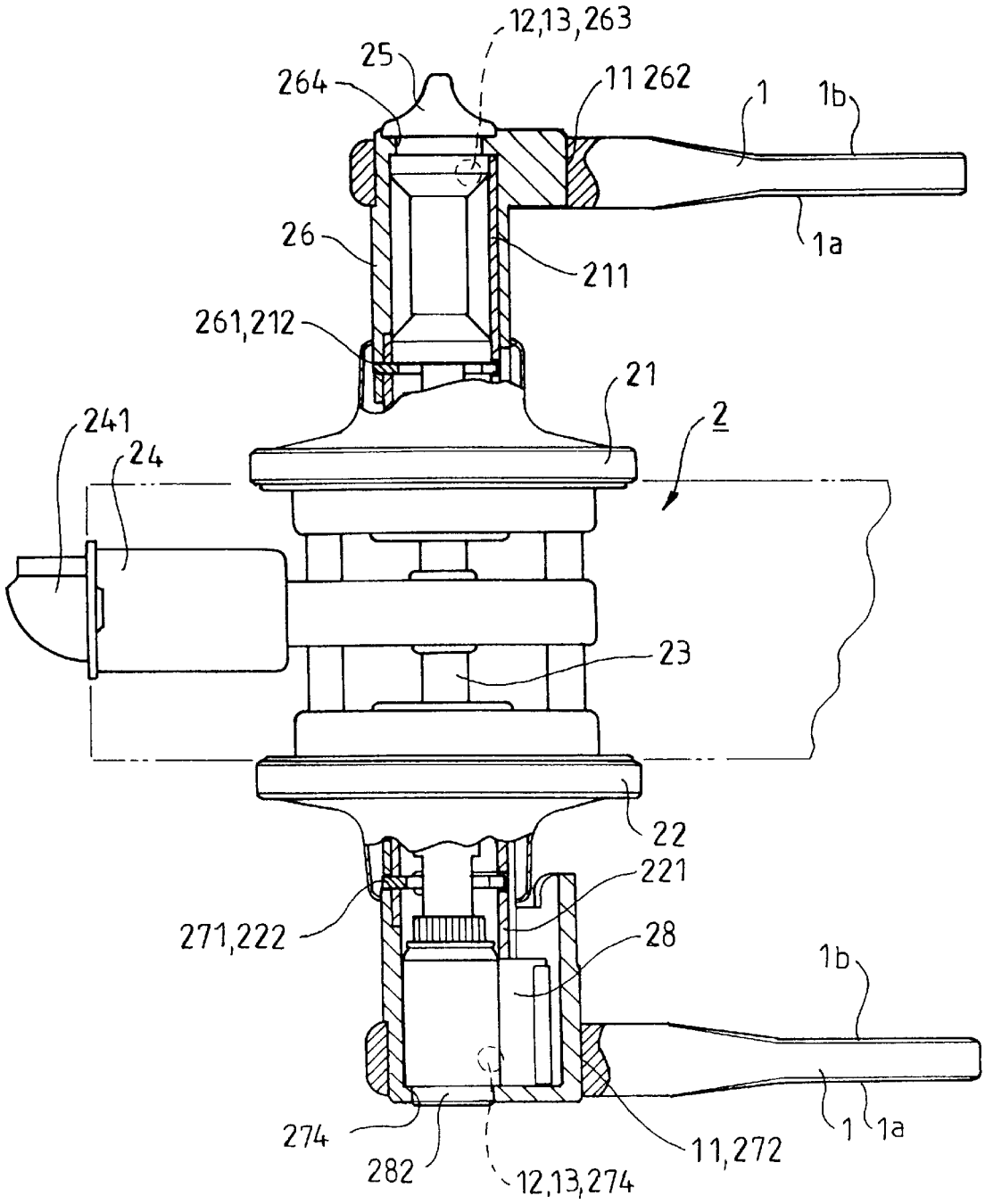
FIG. 5 is a cross-sectional view of the direction changeable handle lock structure taken along line 5—5 as shown in FIG. 4.

Referring to FIGS. 4 and 5, the direction changeable handle lock structure in accordance with the first embodiment of the present invention is mounted on the left side of the door plate. At this time, the combination holes 11 of the two handles 1 are mounted on the combination portion 262 of the inner ornamental cover 26 and the combination portion 272 of the outer ornamental cover 27, and the positioning hole 12 of the handle 1 is located at the lower side of the combination portion 262 of the inner ornamental cover 26 and the combination portion 272 of the outer ornamental cover 27, so that the handles 1 may be fixed by the positioning members 13 respectively. The handle 1 at the left side of the door plate as shown in FIG. 4 may be pressed in the clockwise direction, and the handle 1 at the right side of the door plate as shown in FIG. 6 may be pressed in the counterclockwise direction, to drive the lock tongue 241 of the lock latch 24 to operate.

Figure 6:
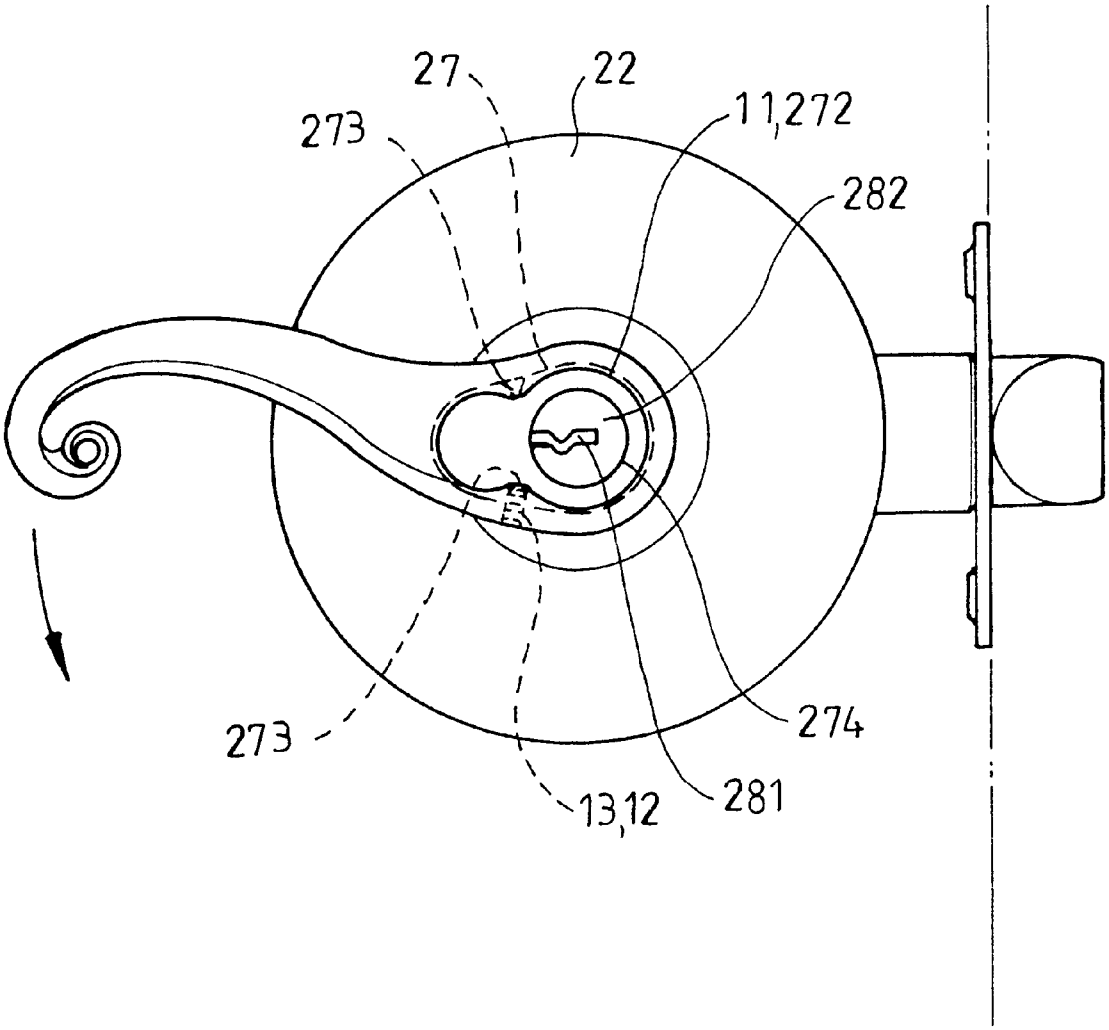
FIG. 6 is a plan assembly view of the direction changeable handle lock structure as shown in FIG. 3, wherein the handle lock is mounted on the right side of the door plate.

Referring to FIG. 6, the direction changeable handle lock structure in accordance with the first embodiment of the present invention is mounted on the right side of the door plate. At this time, the lock core unit 28 and the outer ornamental cover 27 provided by the outer disk unit 22 of the lock set 2 in comparison with that as shown in FIG. 4, the lock core unit 28 and the outer ornamental cover 27 are turned through 180 degrees respectively, and the combination hole 11 of the handle 1 is mounted on the combination portion 272 of the outer ornamental cover 27, with the first surface 1*a* of the handle 1 being located adjacent to the outer ornamental cover 27. Thus, the handle 1 at the outer side of the door plate may be pressed in the counterclockwise direction (the handle 1 at the inner side of the door plate may be pressed in the clockwise direction), to drive the lock tongue 241 of the lock latch 24 to operate. Thus, when replacement is needed, the lock body may be turned through 180 degrees, and the directions of the first surface 1*a* and the second surface 1*b* may be changed.

Figure 7:
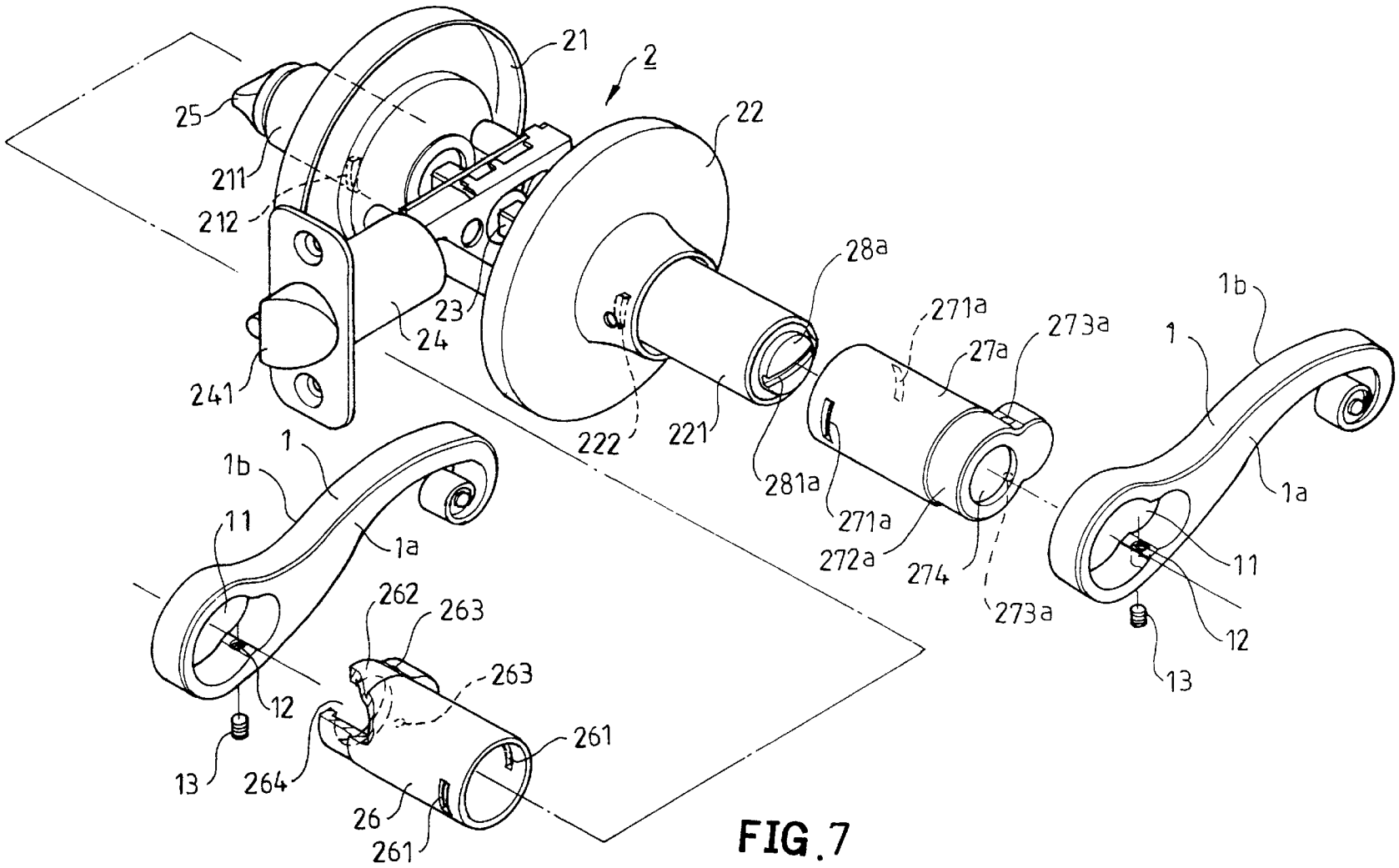
FIG. 7 is an exploded perspective view of a direction changeable handle lock structure in accordance with a second embodiment of the present invention.

Referring to FIG. 7, a direction changeable handle lock structure in accordance with a second embodiment of the present invention is available for a door plate of the bathroom, wherein the knob 25 may be used to control the locking and unlocking actions of the inner side of the door plate, and a copper plate or a thin plate may be used to control the locking and unlocking actions of the outer side of the door plate. The direction changeable handle lock structure in accordance with the second embodiment of the present invention comprises handles 1 and a lock set 2.

The handle 1 in accordance with the second embodiment of the present invention is the same as that in accordance with the first embodiment of the present invention. The handle 1 has a first surface 1*a* and a second surface 1*b*, and is formed with a combination hole 11 extended through the first surface 1*a* and the second surface 1*b*. The handle 1 is formed with a positioning hole 12 communicating with the combination hole 11. The lock set 2 includes an inner disk unit 21, an outer disk unit 22, and a drive shaft 23 extended through the inner disk unit 21 and the outer disk unit 22. The drive shaft 23 is also extended through the drive wheel of the lock latch 24, to draw the lock tongue 241 of the lock latch 24 to operate. In the present embodiment of the present invention, the inner shaft tube 211 of the inner disk unit 21 is provided with a knob 25 that may drive the drive wheel 23 to rotate. The inner ornamental cover 26 is provided with locking slots 261 for locking the locking blocks 212 of the inner shaft tube 211, for positioning the inner ornamental cover 26. The combination portion 262 of the inner ornamental cover 26 is also provided with two opposite positioning cavities 263, for combining the handle 1 by the positioning member 13. The inner ornamental cover 26 has an end face formed with a hole 264 from which the knob 25 protrudes. In the present embodiment of the present invention, the outer shaft tube 221 of the outer disk unit 22 is provided with an unlocking knob 28*a* which is connected with the drive shaft 23. The unlocking knob 28*a* is formed with a straight slot 281*a* for insertion of a copper plate or a thin plate, to drive the drive shaft 23 to rotate. An outer ornamental cover 27*a* is mounted on the outer shaft tube 221. The outer ornamental cover 27*a* is provided with locking slots 271*a* for locking the locking blocks 222 of the outer shaft tube 221 of the outer disk unit 22. The outer ornamental cover 27*a* is provided with a combination portion 272*a* that may be mounted in the combination hole 11 of the handle 1. The combination portion 272*a* is provided with two opposite positioning cavities 273*a*, for fixing the handle 1 by the positioning member 13. The outer ornamental cover 27*a* has an end face formed with a hole 274*a* for exposing the straight slot 281*a* of the unlocking knob 28*a* which may be driven to rotate.

In the present embodiment of the present invention, the handle 1 may be mounted at the left side or right side of the door plate according to the requirement, and the combination hole 11 of the handle 1 is mounted on the combination portion 262 of the inner ornamental cover 26 and the combination portion 272*a* of the outer ornamental cover 27*a*, with the first surface 1*a* or the second surface 1*b* of the handle 1 being located adjacent to the inner ornamental cover 26 and the outer ornamental cover 27*a*, so that the handle 1 may be pressed in the clockwise or counterclockwise direction. Thus, when replacement is needed, the lock body may be turned through 180 degrees, and the directions of the first surface 1*a* and the second surface 1*b* of the handle 1 may be changed.

Figure 8:
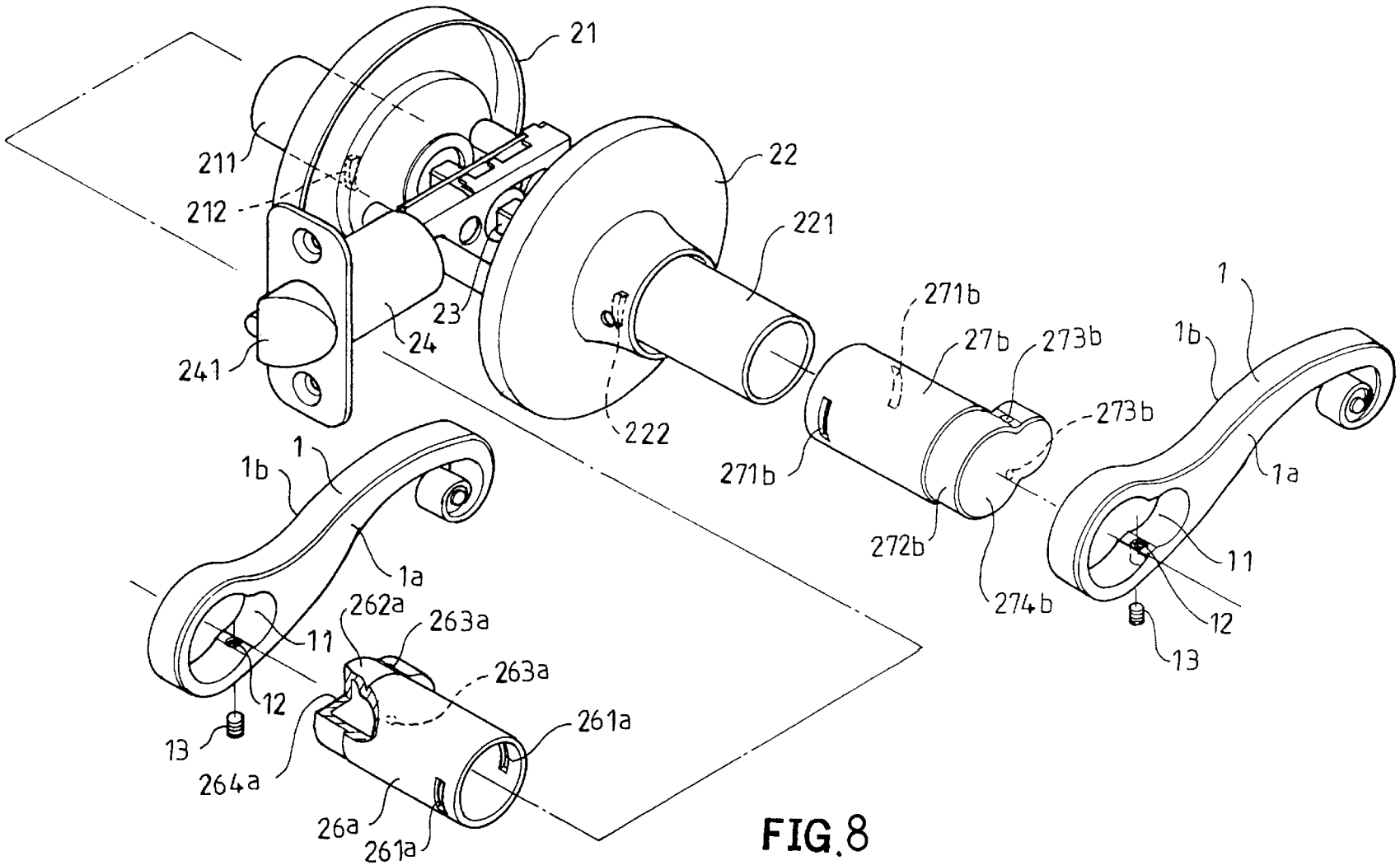
FIG. 8 is an exploded perspective view of a direction changeable handle lock structure in accordance with a third embodiment of the present invention.

Referring to FIG. 8, a direction changeable handle lock structure in accordance with a third embodiment of the present invention is available for a door plate of a passageway without needing to be locked. The direction changeable handle lock structure in accordance with the third embodiment of the present invention comprises handles 1 and a lock set 2.

The handle 1 in accordance with the third embodiment of the present invention is the same as that in accordance with the first embodiment of the present invention. The handle 1 has a first surface 1*a* and a second surface 1*b*, and is formed with a combination hole 11 extended through the first surface 1*a* and the second surface 1*b*. The handle 1 is formed with a positioning hole 12 communicating with the combination hole 11. The lock set 2 includes an inner disk unit 21, an outer disk unit 22, and a drive shaft 23 extended through the inner disk unit 21 and the outer disk unit 22. The drive shaft 23 is also extended through the drive wheel of the lock latch 24, to draw the lock tongue 241 of the lock latch 24 to operate. In comparison with the first embodiment of the present invention, in the present embodiment of the present invention, the inner shaft tube 211 of the inner disk unit 21 is not provided with a knob 25. The end face of the inner ornamental cover 26*a* mounted on the inner shaft tube 211 is formed with a closed face 264*a*. The inner ornamental cover 26*a* is provided with locking slots 261*a* for locking the locking blocks 212 of the inner shaft tube 211, for positioning the inner ornamental cover 26*a*. The combination portion 262*a* of the inner ornamental cover 26*a* is also provided with two opposite positioning cavities 263*a*, for combining the handle 1 by the positioning member 13. In comparison with the first embodiment of the present invention, in the present embodiment of the present invention, the outer shaft tube 221 is not provided with the lock core unit 28, and the outer shaft tube 221 is directly combined with the outer ornamental cover 27*b*. The outer ornamental cover 27*b* is provided with locking slots 271*b* for locking the locking blocks 222 of the outer shaft tube 221 of the outer disk unit 22. The outer ornamental cover 27*b* is provided with a combination portion 272*b* that may be mounted in the combination hole 11 of the handle 1. The combination portion 272*b* is provided with two opposite positioning cavities 273*b*, for fixing the handle 1 by the positioning member 13. In the present embodiment of the present invention, the end face of the outer ornamental cover 27*b* is formed with a closed face 274*b*.

In the present embodiment of the present invention, the handle 1 may be mounted at the left side or right side of the door plate according to the requirement, and the combination hole 11 of the handle 1 is mounted on the combination portion 262*a* of the inner ornamental cover 26*a* and the combination portion 272*b* of the outer ornamental cover 27*b*, with the first surface 1*a* or the second surface 1*b* of the handle 1 being located adjacent to the inner ornamental cover 26 and the outer ornamental cover 27, so that the handle 1 may be pressed in the clockwise or counterclockwise direction. Thus, when replacement is needed, the lock body may be turned through 180 degrees, and the directions of the first surface 1*a* and the second surface 1*b* of the handle 1 may be changed.

Accordingly, in the direction changeable handle lock structure of the present invention, the handle may be mounted at the left side or right side of the door plate according to the user's requirement, and may be replaced easily, with the first surface or the second surface being exposed outward. Thus, the manufacturing factor only needs to produce one kind of handle which may be used broadly. In addition, the lock structure may be available for a handle lock having a lock core unit or a handle lock used in the bathroom, and a handle lock used in a passageway without needing to be locked. Thus, the cost of the dies may be greatly reduced for the factory, thereby greatly reducing the cost of production. In addition, the consumer will not erroneously buy the lock structure when purchasing.

Although the invention has been explained in relation to its present embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A direction changeable handle lock structure, comprising:

at least one handle, provided with a first surface and a second surface, and formed with a combination hole extended through the first surface and the second surface, the combination hole comprises a central hole and an eccentric hole in communication therewith, the handle formed with a positioning hole communicating with the combination hole; and a lock set, including an inner disk unit, an outer disk unit, and a drive shaft, the drive shaft extended through the inner disk unit, the outer disk unit, and a lock latch, the inner disk unit provided with an inner shaft tube, the outer disk unit provided with an outer shaft tube, for combination with an inner ornamental cover and an outer ornamental cover, each of the inner ornamental cover and the outer ornamental cover being provided with a radially protruded combination portion, so that the eccentric hole of the combination hole of the handle is mountable on the combination portion from the first surface or the second surface, and the handle is fixable by a positioning member.

2. The direction changeable handle lock structure as claimed in claim 1, wherein the positioning hole of the handle is located at a bottom surface of the handle.

3. The direction changeable handle lock structure as claimed in claim 1, wherein each of the inner ornamental cover and the outer ornamental cover has an end face provided with a hole.

4. The direction changeable handle lock structure as claimed in claim 1, wherein each of the inner ornamental cover and the outer ornamental cover has an end face formed with a closed face.

5. The direction changeable handle lock structure as claimed in claim 1, wherein the positioning hole of the handle is a screw bore configured for screwing the positioning member having threads.

6. A direction changeable handle lock structure, comprising:

at least one handle, provided with a first surface and a second surface, and formed with a combination hole extended through the first surface and the second surface, the handle formed with a positioning hole communicating with the combination hole;

a lock set, including an inner disk unit, an outer disk unit, and a drive shaft, the drive shaft extended through the inner disk unit, the outer disk unit, and a lock latch, the inner disk unit provided with an inner shaft tube, the outer disk unit provided with an outer shaft tube, for combination with an inner ornamental cover and an outer ornamental cover, each of the inner ornamental cover and the outer ornamental cover being provided with a combination portion, so that the combination hole of the handle may be mounted on the combination portion from the first surface or the second surface, and the handle may be fixed by a positioning member;

wherein the positioning hole of the handle is a screw bore configured for screwing the positioning member having threads; and wherein the combination portion of each of the inner ornamental cover and the outer ornamental cover is provided with at least one positioning cavity on which one end of the positioning member may be rested.

* * * * *